United States Patent [19]

Eppinger

[11] Patent Number: 4,962,702

[45] Date of Patent: Oct. 16, 1990

[54] SCREEN PRINTING MACHINES

[75] Inventor: Otto R. Eppinger, Parkdale, Australia

[73] Assignee: Reefdale Pty. Ltd., Braeside, Australia

[21] Appl. No.: 332,330

[22] PCT Filed: Aug. 26, 1988

[86] PCT No.: PCT/AU88/00329

§ 371 Date: Apr. 10, 1989

§ 102(e) Date: Apr. 10, 1989

[87] PCT Pub. No.: WO89/01865

PCT Pub. Date: Mar. 9, 1989

[30] Foreign Application Priority Data

Aug. 28, 1987 [AU] Australia ..... PI4030/87

[51] Int. Cl.[5] ..... B41F 15/36

[52] U.S. Cl. ..... 101/114; 101/115; 101/123

[58] Field of Search ..... 101/114, 115, 123, 129; 118/301

[56] References Cited

U.S. PATENT DOCUMENTS

| | | | |
|---|---|---|---|
| 2,484,671 | 10/1949 | Bauman . | |
| 2,695,592 | 2/1950 | Szczepanski | 118/301 |
| 2,885,957 | 5/1959 | Hansen . | |
| 3,096,709 | 7/1963 | Eldred et al. . | |
| 4,084,504 | 4/1978 | Fuchs . | |
| 4,649,815 | 3/1987 | Richardson | 101/126 |
| 4,750,419 | 6/1988 | Meredith | 101/40 |
| 4,753,162 | 6/1988 | Bubley | 101/115 |

FOREIGN PATENT DOCUMENTS

| | | |
|---|---|---|
| 70490/87 | 10/1987 | Australia . |
| 0268466 | 5/1988 | European Pat. Off. . |

*Primary Examiner*—Edgar S. Burr
*Assistant Examiner*—Joseph R. Keating
*Attorney, Agent, or Firm*—Fleit, Jacobson, Cohn, Price, Holman & Stern

[57] ABSTRACT

A print head assembly for use with a screen printing machine of the carousel type having a multiple armed fixed frame and a multiple armed movable frame mounted for rotation relative thereto. The print head assembly (40) comprises: a mounting frame (45) operatively connected to an arm of the carousel. A carriage (44) is operatively connected to the mounting frame (45) and arranged for reciprocating movement relative thereto along a path of travel. Drive means is provided for causing the reciprocating movement, the drive means comprising a piston/cylinder assembly (41) including a cylinder (43) having a longitudinal axis, and opposed ends with a piston rod (42) extending from one of those ends there being a region defined between the lateral axes at respective ends of the cylinder (43) these lateral axes extending at right angles to the longitudinal axis of the assembly. The carriage (44) is characterized in that it is operatively connected to the piston rod (42) and arranged so that at least along part of its reciprocating path of travel it is disposed with the region between the ends of the cylinder (43).

9 Claims, 3 Drawing Sheets

SCREEN PRINTING MACHINES

This invention relates to an improved print head assembly for use in screen printing machines and more particularly to printing machines of the carouse type.

Screen printing machines of this type may comprise a multiple armed fixed frame and a complementary multiple armed frame which is mounted for rotation relative to the fixed frame. The machine further includes a plurality of print heads and screen platens one group being operatively connected to respective movable arms and the other group being operatively connected to respective fixed arms. Each print head comprises a movable carriage which is mounted for reciprocating movement relative to the arm upon which it is mounted the carriage having suitable spray heads and/or other application devices thereon.

One currently known means for driving each carriage comprises a piston/cylinder assembly which is mounted to a respective arm of the frame and is arranged with the piston rod being connected more or less directly to the carriage with the carriage being located beyond the piston rod at the outer end of the arm.

A major disadvantage of this arrangement is that in many instances extremely long frame arms are required to mount the piston/cylinder assembly in line with the carriage. This particular in-line arrangement can also lead to a general lack of stability in the mounting of the cylinder to the arm. Furthermore, access to the cylinder for the purpose of adjustment can be difficult because it is spaced so far from the free end of the frame arm.

It is an object of the present invention in one aspect to provide an improved print head assembly which alleviates one or more of the aforementioned problems.

According to one aspect of the present invention there is provided a print head assembly for use with a screen printing machine of the type including a multiple armed fixed frame and a complementary multiple armed movable frame which is mounted for rotation relative to the fixed frame, the print head assembly comprising: a mounting frame operatively connected to an arm of the carousel; a carriage operatively connected to the mounting frame and arranged for reciprocating movement relative thereto along a path of travel; drive means for causing the reciprocating movement, the drive means comprising a piston/cylinder assembly having a longitudinal axis, a cylinder having opposed ends with a piston rod extending from one of those ends there being a region defined between the lateral axes at respective ends of the cylinder these lateral axes extending at right angles to the longitudinal axis of the assembly; the carriage being operatively connected to the piston rod by coupling means and arranged so that at least along part of its reciprocating path of travel it is disposed within the region.

The mounting frame may include at least one elongated guide member along which the carriage can travel. Preferably the longitudinal axis of the guide member and the cylinder are substantially parallel and laterally off-set from one another. It is desirable that the cylinder of the piston/cylinder assembly is mounted in fixed relation on the mounting frame.

The mounting frame may further include a pair of spaced apart end plates with the cylinder of the piston/-cylinder assembly being mounted between those end plates. The elongated guide member is preferably also mounted between the end plates parallel to and spaced from the cylinder. Preferably the guide member is disposed below the cylinder. It will be appreciated that the piston/cylinder assembly can be either pneumatic or hydraulically actuated and suitable valves and other controls are provided to control its stroke.

The coupling means for operatively connecting the piston rod to the carriage, may include an elongated transfer tube which extends generally parallel to the piston rod and a coupling plate operatively interconnecting the piston rod and the transfer tube. Conveniently the transfer tube can be used for housing delivery lines for the spray heads on the carriage.

A support rod may be provided for slidably mounting the coupling plate the support rod extending between the adjacent end plate and the main frame of the carousel. The distance between the coupling plate support on the support rod and the mounting of the carriage to the guide bar provides for an extremely stable system.

Preferably the carriage is mounted on two elongated guide bars which are spaced apart and parallel to the longitudinal axes of the cylinder.

There may also be provided an adjustment system which enables adjustment of the length of stroke of the carriage. The system comprises an elongated track having a longitudinal axis which extends generally parallel to the direction of travel of the carriage and a pair of abutment blocks operatively supported on the track so that they can adopt selected positions along the length thereof, the abutment blocks being disposed relative to the carriage so that they can be engaged by the carriage during its reciprocating movement. Control means may be provided which is associated with the track and is responsive to engagement of the carriage with an abutment block. The arrangement is such that when the carriage engages an abutment block the control means causes the piston/cylinder to change its reciprocating direction.

Preferably the track is mounted for limited movement in the direction of its longitudinal axis so that upon engagement of an abutment block by the carriage the track is shifted slightly in the axial direction this axial movement causing actuation of the control means.

The control means may comprise a pair of control switches operable to activate the control valves for the piston/cylinder assembly. The control switches may be arranged to be operable by engagement with a portion of the track or a member operatively connected to the track. For example, each switch may be engageable by a triggering shoulder formed on the track.

The position of the abutment blocks is adjustable along the length of the elongated member and may include a locking clamp which releasably secures the block to the track.

Preferred embodiments of the invention will hereinafter be described with reference to the accompanying drawings in which.

Figure 1:
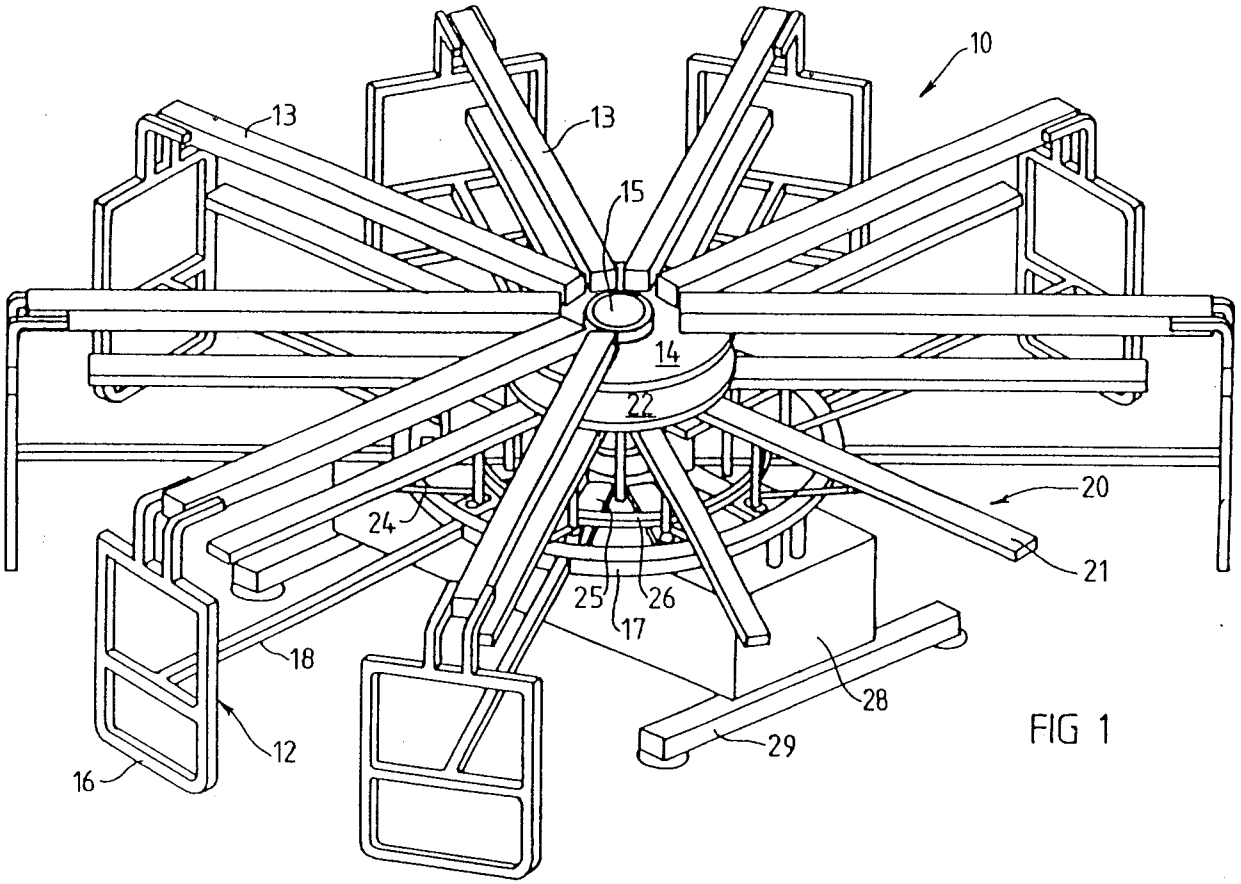
FIG. 1 is a perspective view of the principle frame elements of a screen printing carousel.

The screen printing carousel 10 illustrated in FIG. 1 includes a fixed frame 12 and a rotatable frame 20. Fixed frame 12 has multiple arms 13 that project radially from a central disk 14 which is secured to an upstanding post 15. At their outer ends, arms 13 may be supported on rectangular frame stands 16 which are themselves braced from a fixed angle-section ring 17 by respective radial struts 18.

The movable frame 20 likewise comprises of multiple radially projecting arms 21 fixed to a second disk 22 which forms part of a structure rotatable on post 15. Arms 21 extend in cantilever fashion and are braced by respective uprights 23 and adjustable diagonal struts 24 to underlying plates 25 which form a further part of the rotatable structure and are themselves rigidified by an inner angle-section ring 26.

Post 15 is supported on a broad pedestal box 28 that itself rests upon spaced elongate stabilizing feet 29. In a complete installation, arms 13 carry respective print heads and the cantilever arms 21 support platens for the screens.

Box pedestal 28 houses a rotary indexing mechanism which may be of the type described in applicant's International application No. PCT/AU88/00232 for rotating moving frame 20 about post 15. Arms 21 are equiangularly spaced by an angle equal to the angular spacing of arms 13 It will be seen that two of the arms 13 are missing and it is in this gap that the material or substrate to be printed is positioned on the printing screens on the cantilever arms and retrieved therefrom after having executed a complete circuit of the carousel. Each screen must stop at each station defined by the arms 13 and it is this step motion with which the mechanism in accordance with the invention is concerned. Means, not detailed herein, is of course provided for accurately locating and maintaining each indexed position.

Figure 2:
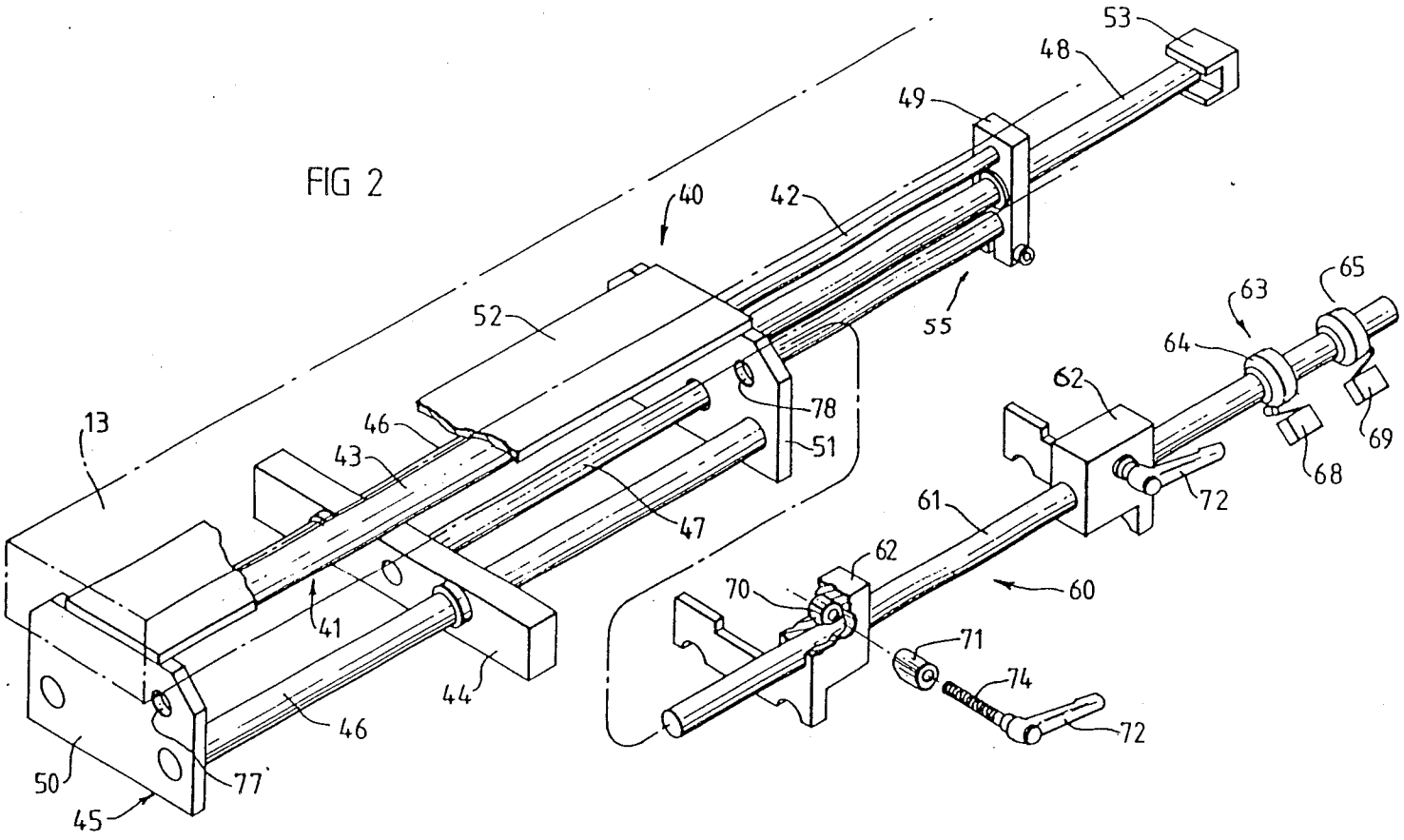
FIG. 2 is a perspective view of a spray head assembly according to the invention.
Figure 3:
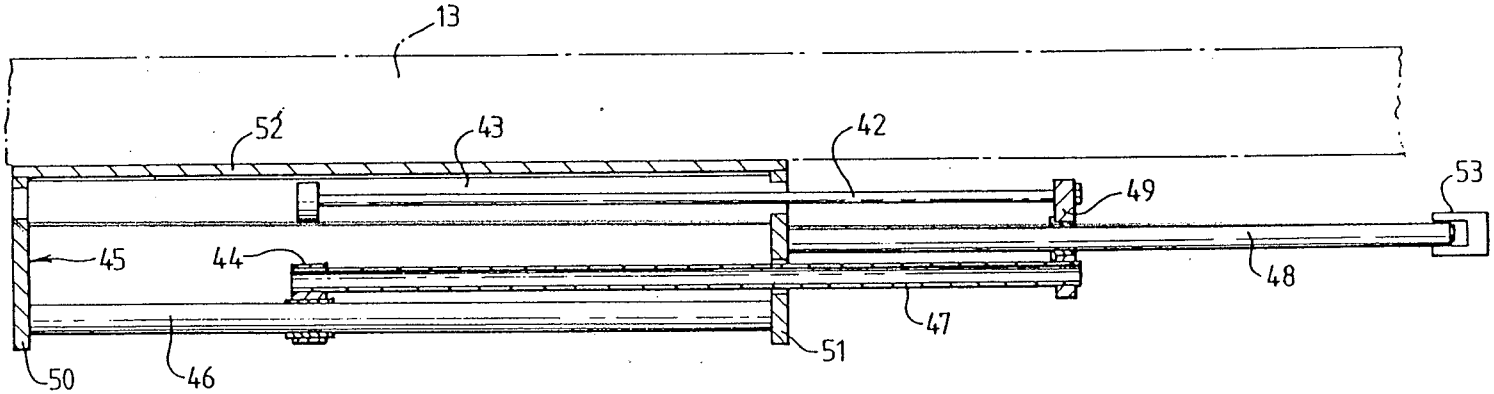
FIG. 3 is a sectional side elevation of the spray head assembly as shown in FIG. 2.

Referring to FIG. 2 and 3 of the drawings the spray head assembly 40 is shown in schematic form and comprises a mounting frame 45 which is operatively supported by arm 13 of the fixed frame 12. The arm 13 is shown in phantom outline in FIGS. 2 and 3. The mounting frame 45 includes a pair of end plates 50 and 51 interconnected by frame member 52 which is attached to arm 13, and has a carriage 44 mounted for reciprocating movement on guide tracks 46. The carriage 44 is adapted to carry spraying heads thereon.

The carriage is driven by piston/cylinder assembly 41 comprising a cylinder 43 which is fixedly mounted to the mounting frame 45 and includes a piston rod 42. Connection between the carriage 44 and the piston rod 42 is by way of coupling means 55 comprising a connecting plate 49 and transfer tube 47. The transfer tube 47 conveniently carries the delivery lines and other control lines for the spray heads mounted on the carriage 44. A support rod 48 is provided between the central stand of the carousel frame and one of the plates 51 of the mounting frame 45. This support rod 48 is supported at its free end within a channel 53 which is secured to the central stand of the carousel frame. This support rod providing additional support for the system during the reciprocating movement of the piston/cylinder assembly and carriage.

The adjustment system for varying the stroke of the piston/cylinder assembly and carriage is schematically illustrated in FIG. 2. The system 60 comprises elongated guide track 61 in the form of a rod like member which is mounted in holes 77 and 78 in end plates 50 and 51 so that its longitudinal axis is generally parallel to the direction of travel of the carriage 44. The guide track is arranged for limited movement and springs (not shown) may provide to correctly center the track. A pair of abutment blocks 62 are carried on the guide track, these blocks being slidable along the guide track 61 so that they can be located in different positions there along and be locked in those positions. These abutment blocks 62 are arranged to be engaged by a section of the carriage during its stroke. Each abutment block 62 includes a main body having wedge members 70 and 71 mounted on threaded shaft 74 and movable by handle 72 which causes rotation of shaft 74. The track 61 is mounted so that when engaged by the carriage via the abutment block it can move slightly one way or the other so that it can trigger the valves for the piston/cylinder assembly via the control means 63. Springs may be provided to cushion the limited axial movement of the guide track when the carriage engages an abutment block.

The control means 63 comprises actuating elements 64 and 65 on/or operatively connected to the guide track these actuating elements being adapted to engage control switches 68 and 69 which in turn are operatively connected to the control valves of the piston/cylinder assembly.

The actuating elements shown in FIG. 2 are defined by two shoulders on the guide track 61 arranged to trigger the switches 68 and 69. In another embodiment the actuating elements 64 and 65 are triggering members which are secured to track 61.

It will be appreciated that in operation when the carriage is moving in one direction and engages an abutment this causes the triggering of one of the switches to thereby control the valves of the piston/cylinder assembly to change the direction of reciprocation thereof.

The invention in its essential and preferred form provides many advantages over prior art arrangement. For example, because of the arrangement of the print head assembly according to the present invention a more compact assembly for a given print stroke is achieved thereby reducing the overall dimensions of the machine. The arrangement of the support bearings for the carriage and the connection between the piston rod and the transfer tube is relatively large thereby reducing radial loads due to any twisting movement on the carriage. Furthermore, the adjustment system limits fatigue on various components which are used in the print head assembly.

Finally, various alterations, modifications and or additions may be incorporated into the various constructions and arrangements of parts without departing from the spirit and ambit of the invention.

I claim:

1. A screen printing machine comprising a fixed frame having a plurality of circumferentially spaced radially extending arms, a complementary movable frame having a plurality of circumferentially spaced radially extending arms, said movable frame being mounted for rotation relative to the fixed frame, at least one print head assembly comprising:

a mounting frame operatively connected to one of said arms of the fixed frame:

a carriage operatively connected to the mounting frame and arranged for reciprocating movement relative thereto along a path of travel;

drive means for causing the reciprocating movement, the drive means comprising a piston/cylinder assembly including a cylinder having a longitudinal axis, and opposed ends, each end having a lateral axis extending laterally with respect to the longitudinal axis and a piston rod extending from one of those ends, a region defined between the lateral axes at respective ends of the cylinder, the lateral axes extending at right angles to the longitudinal axis of the assembly;

coupling means for operatively connecting the carriage to the piston rod and the carriage being arranged so that at least along part of its reciprocating path of travel the carriage is disposed within the region.

2. A screen printing machine according to claim 1, wherein said mounting frame includes at least one elongated guide member having a longitudinal axis along which the carriage can travel, the longitudinal axes of said at least one elongated guide member and the cylinder being substantially parallel and laterally off-set from one another.

3. A screen printing machine according to claim 2, wherein said mounting frame further includes a pair of spaced apart end plates with the cylinder of the piston/-cylinder assembly being mounted between those end plates, said at least one elongated guide member also being mounted between the end plates parallel to and spaced from the cylinder.

4. A screen printing machine according to claim 1, wherein said coupling means for operatively connecting the piston rod to the carriage, comprises an elongated transfer tube extending generally parallel to the piston rod and further including a coupling plate operatively interconnecting the piston rod and the transfer tube.

5. A screen printing machine according to claim 4, further including a support rod for slidably supporting the coupling plate, the support rod extending between an adjacent end plate and the fixed or movable frame.

6. A print head assembly according to claim 1, further including an adjustment system enabling adjustment of the length of stroke of the carriage, the system comprising an elongated track having a longitudinal axis which extends generally parallel to the direction of the travel of the carriage; a pair of abutment blocks operatively supported on the track so that the blocks can adopt selected positions along the length thereof, the abutment blocks being disposed relative to the carriage so that the blocks can be engaged by the carriage during its reciprocating movement, control means associated with the track and being responsive to engagement of the carriage with an abutment block so that when the carriage engages an abutment block, the control means causes the piston/cylinder assembly to change its reciprocating direction.

7. A print head assembly according to claim 6, wherein said track is mounted for limited movement in the direction of its longitudinal axis so that upon engagement of an abutment block by the carriage the track is shifted slightly in the axial direction this axial movement causing actuation of the control means.

8. A print head assembly according to claim 7, wherein said control means comprises a pair of control switches operable to activate control valves for the piston/cylinder assembly, said control switches being arranged to be operable by engagement with a portion of the track or a member operatively connected to the track.

9. A print head assembly according to claim 8, wherein the position of the abutment blocks is adjustable along the length of the elongated member and include a locking clamp which releasably secures the block to the track.

* * * * *